US008859486B2

(12) United States Patent
Petrovicova et al.

(10) Patent No.: US 8,859,486 B2
(45) Date of Patent: Oct. 14, 2014

(54) ANHYDROUS DETERGENT COMPOSITION COMPRISING A CLAY MIXTURE PROCESSED WITH QUATERNARY AMMONIUM SALTS

(71) Applicant: Church & Dwight Co., Inc., Princeton, NJ (US)

(72) Inventors: Elena Petrovicova, Princeton, NJ (US); Steven A. Bolkan, Hopewell, NJ (US); Sarah Waite, Maple Shade, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 0 days.

(21) Appl. No.: 13/827,109

(22) Filed: Mar. 14, 2013

(65) Prior Publication Data

US 2014/0274861 A1 Sep. 18, 2014

(51) Int. Cl.

| | |
|---|---|
| ***C11D 3/08*** | (2006.01) |
| ***C11D 3/386*** | (2006.01) |
| ***C11D 3/12*** | (2006.01) |
| ***C11D 17/00*** | (2006.01) |

(52) U.S. Cl.

CPC ..... *C11D 3/1246* (2013.01); *C11D 17/0013* (2013.01)

USPC ..... 510/507; 510/276; 510/300; 510/302; 510/320; 510/329; 510/375; 510/392; 510/418; 510/515

(58) Field of Classification Search

USPC ..... 510/507, 276, 300, 302, 320, 329, 375, 510/392, 418, 515

See application file for complete search history.

(56) References Cited

U.S. PATENT DOCUMENTS

| | | | | |
|---|---|---|---|---|
| 3,630,929 | A | 12/1971 | Van Dijk | |
| 4,264,466 | A | 4/1981 | Carleton et al. | |
| 4,316,812 | A | 2/1982 | Hancock et al. | |
| 4,661,280 | A | 4/1987 | Ouhadi et al. | |
| 4,846,992 | A * | 7/1989 | Fonsny | 510/296 |
| 4,929,380 | A | 5/1990 | Schulz et al. | |
| 4,931,195 | A * | 6/1990 | Cao et al. | 510/304 |
| 5,004,556 | A | 4/1991 | Julemont et al. | |
| 5,102,574 | A | 4/1992 | Russell et al. | |
| 5,176,713 | A | 1/1993 | Dixit et al. | |
| 5,336,647 | A | 8/1994 | Naé et al. | |
| 5,429,999 | A | 7/1995 | Naé et al. | |
| 5,718,841 | A | 2/1998 | Mardis et al. | |
| 6,036,765 | A * | 3/2000 | Farrow et al. | 106/487 |
| 6,589,930 | B2 | 7/2003 | Jacques et al. | |
| 6,656,901 | B2 | 12/2003 | Moorfield et al. | |
| 7,012,055 | B2 | 3/2006 | Findlay et al. | |
| 7,105,476 | B2 | 9/2006 | Whilton | |
| 7,419,540 | B2 | 9/2008 | Möller et al. | |
| 8,342,217 | B2 * | 1/2013 | Bergman et al. | 152/503 |
| 8,389,447 | B2 * | 3/2013 | Dino et al. | 507/240 |
| 2004/0142841 | A1 * | 7/2004 | de Buzzaccarini et al. | 510/296 |
| 2005/0087721 | A1 * | 4/2005 | Iyengar et al. | 252/71 |
| 2005/0123487 | A1 * | 6/2005 | Spadini et al. | 424/47 |
| 2007/0251626 | A1 * | 11/2007 | Hotaling et al. | 152/520 |
| 2008/0263778 | A1 * | 10/2008 | Baars et al. | 8/108.1 |
| 2009/0118149 | A1 * | 5/2009 | Ohira et al. | 508/207 |
| 2010/0314016 | A1 * | 12/2010 | Bergman et al. | 152/503 |
| 2011/0036497 | A1 * | 2/2011 | Lammerschop et al. | 156/330 |
| 2011/0143938 | A1 * | 6/2011 | Fowler et al. | 504/103 |
| 2013/0118518 | A1 * | 5/2013 | Spadini et al. | 132/200 |
| 2013/0266736 | A1 * | 10/2013 | Wickert et al. | 427/427 |

* cited by examiner

*Primary Examiner* — Charles Boyer
(74) *Attorney, Agent, or Firm* — Stuart D. Frenkel

(57) ABSTRACT

An anhydrous composition comprising a liquid phase, a dispersed solid phase and a processed clay mixture. The composition has a minimum amount of water and is surprisingly stable during its long-term storage, with no phase separation and minimal activated oxygen loss.

19 Claims, 3 Drawing Sheets

ANHYDROUS DETERGENT COMPOSITION COMPRISING A CLAY MIXTURE PROCESSED WITH QUATERNARY AMMONIUM SALTS

FIELD OF THE INVENTION

The present invention relates to a substantially anhydrous detergent composition that contains an effective amount of an insoluble stabilizer, such as clay, in a dispersed particulate form.

BACKGROUND OF THE INVENTION

Liquid detergents are often considered to be more convenient to employ than dry powdered or particulate products. They are readily measurable, rapidly dissolved in the wash water, capable of being easily applied in concentrated solutions or dispersions to soiled areas on garments to be laundered and are non-dusting. Additionally, the liquid detergents may include materials that could not stand drying operations without deterioration, which materials are often desirably employed in the manufacture of particulate detergent products.

In particular, liquid detergent ingredients such as enzymes, bleach (e.g. hydrogen peroxide) and alkalizing agents contribute greatly to the removal of stains and soils. Multiple enzymes are typically used in detergent formulations to deliver a wide range of stain removal. These enzymes include, but are not limited to proteases (for stains/soils containing proteins such as dairy or grass), lipases (for stains/soils containing lipids such as butter or make-up), amylases (for stains/soils containing starches such as potatoes or gravy), and cellulases (for stains/soils containing cellulose such as fruits or vegetables). Meanwhile, bleaches work effectively against non-fatty stains such as red wine or coffee. Higher alkalinity can be provided by sodium carbonate or percarbonate, which helps to counteract water hardness and increase detergency.

However, most laundry detergents do not deliver all three mechanisms of stain removal due to incompatibility and interactions of the components that deliver these chemistries, particularly because current detergent systems are water based, which presents a challenge in stabilizing such a system. For example, enzymes that are typically only stable at a pH level of 6-9 can be unstable in a large presence of water. Bleaches, based on sodium percarbonates or hydrogen peroxide, are also unstable in aqueous environments at an alkaline pH level.

One of the approaches to deliver all of the cleaning ingredients together is to develop a pourable and substantially anhydrous paste or slurry system, which includes suspended percarbonate and/or carbonate salts and enzymes. The substantially anhydrous system is beneficial because the sodium percarbonate and enzymes would be stable in the absence of water, and they remain inactive until the system is in contact with a wash liquor. Furthermore, the incorporation of these salts in a stable anhydrous composition also provides an option to meter and package the composition in a dissolvable pouch or container. A dosed and contained detergent composition that requires minimal handling is highly desirable by consumers.

Various attempts are well known in the prior art to produce stable anhydrous detergents. For example, U.S. Pat. No. 4,264,466 to Carleton et al. teaches liquid laundry detergents that contain a chain structure type clay that is selected from attapulgite, sepiolite and palygorskite clays as a suspending agent.

Another example is U.S. Pat. No. 6,656,901 to Moorfield et al., which teaches a fabric care composition comprising an organophilic clay, a functionalized oil and water to provide softness benefits to fabric.

U.S. Pat. No. 4,846,992 to Fonsny teaches a non-aqueous liquid laundry detergent composition comprising a suspension of builder salt in a liquid nonionic surfactant. The stability of the composition is improved by the addition of small amounts of organophilic-modified clay. The stability is further enhanced by reducing the solid particulate matter to a particle size below about 15 microns.

U.S. Pat. No. 4,316,812 to Hancock et al. teaches a liquid detergent composition comprising a dispersion of solids that includes one or more builders and bleach. The solids have an average particle diameter of less than 10 microns. Suitable inorganic builders include phosphates, tetrasodium pyrophosphate, sodium hexametaphosphate and, preferably, sodium tripolyphosphate, carbonates (e.g. sodium carbonate), sodium bicarbonate and sodium sesquicarbonate, clays (e.g. kaolin, montmorillonites and sodium bentonite), sodium borate, sodium citrate sodium meta-silicate and nitrilotriacetic acid.

U.S. Pat. No. 4,661,280 to Ouhadi et al. teaches a liquid heavy duty laundry detergent composition comprising a suspension of builder salt in a liquid nonionic surfactant, and at least one additional suspension stabilizing agent that is selected from the following: quaternary ammonium compounds, phosphoric esters, modified clays and mixtures thereof.

U.S. Pat. No. 5,176,713 to Dixit et al. teaches a non-aqueous liquid laundry detergent composition comprising a builder salt suspension in a liquid nonionic surfactant. The composition is stabilized against phase separation by the addition of small amounts of low density fillers, such as hollow plastic or glass microspheres.

The above references teach various means to stabilize liquid detergent ingredients with the addition of fillers, builders and/or salts. However, there remains a need to formulate a stable liquid anhydrous detergent composition with a high proportion of dispersed solid materials.

SUMMARY OF THE INVENTION

A substantially anhydrous detergent composition is provided comprising a liquid phase, a dispersed solid phase and a processed clay mixture to stabilize the composition. The composition is surprisingly stable during its long-term storage, with no phase separation and minimal activated oxygen loss.

BRIEF DESCRIPTION OF THE DRAWINGS

For a fuller understanding of the nature and advantages of the present invention, reference should be made to the following detailed description read in conjunction with the accompanying drawings.

DETAILED DESCRIPTION OF THE INVENTION

Figure 1A:
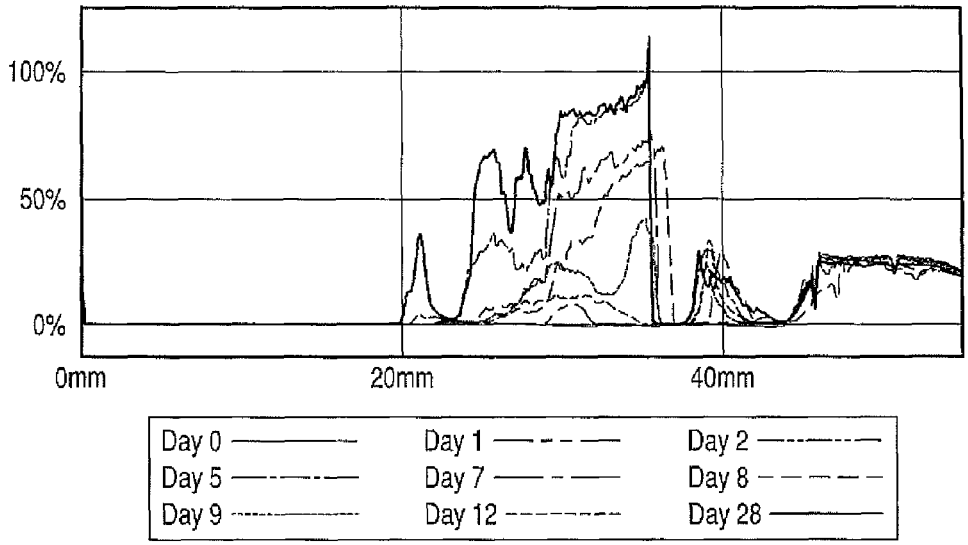
FIG. 1A illustrates a transmission scan of a detergent composition comprising 1.8 wt. % bentonite clay that was aged at 122° F. from Day 0 to Day 28.

A substantially anhydrous detergent composition is provided comprising a liquid phase, a dispersed solid phase and a processed clay mixture to stabilize the composition. The liquid phase comprises at least one surfactant and at least one solvent. The dispersed solid phase comprises at least one enzyme, and either at least one builder, at least one bleaching agent or mixtures thereof. The processed clay mixture is pre-treated with alkyl quaternary ammonium compounds. The composition is surprisingly stable during long-term storage, with no phase separation and minimal activated oxygen loss. In particular, the composition is stable for at least 28 days when stored at room temperature and up to 140° F., and has less than 4% of active oxygen loss when stored up to 42 days.

Liquid Phase

As noted above, the liquid phase is comprised of at least one surfactant and at least one solvent. The surfactant is present in an amount of about 30 wt. % to 95 wt. %, preferably about 40 wt. % to 75 wt. % and, more preferably, about 40 wt. % to 65 wt. % of the anhydrous detergent composition. The solvent is present in an amount of about 1 wt. % to 30 wt. %, preferably about 1 wt. % to 20 wt. %, and, more preferably, about 2 wt. % to 10 wt. % of the anhydrous detergent composition. The surfactant is selected from nonionic, anionic, cationic, zwitterionic surfactants and mixtures thereof. The solvent is selected from hydrocarbon, alkylene glycol, alcohol solvents and mixtures thereof. The presence of surfactants as a predominant part of the liquid phase serves two purposes. First, it serves as the majority of the liquid vehicle for the suspended solids to allow one to formulate a compacted composition, which is needed only in small quantities for cleaning, i.e. to wash a load of fabric in the context of laundry detergents.

A second advantage is that the surfactants exclude water from the detergent composition. This is particularly useful when it is necessary to incorporate water sensitive materials, such as enzymes, peroxygen and/or chlorine bleaches, into the anhydrous detergent composition.

Nonionic Surfactants

Various nonionic surfactants are useful in the composition of the present invention. The only requirement is that the surfactants should be in a liquid state at the temperature of use, which is usually room temperature.

Nonionic surfactants for the instant composition are of three basic types: alkylene oxide condensates, amides and semi-polar nonionics. Examples of alkylene oxide condensates include:

1) The condensates of aliphatic alcohols with ethylene oxide. Examples of commercially available nonionic surfactants of this type include TERGITOL® 15-S-5 marketed by the Dow Chemical Company, NEODOL® 23-5 marketed by the Shell Chemical Company and Kyro EOB marketed by The Procter & Gamble Company.

2) Polyethylene oxide condensates of alkyl phenols, such as IGEPAL® CO-610 marketed by the Rhodia Inc., SURFONIC® N-95, marketed by Huntsman Co., Inc., and TRITON® X-45, X-100 and X-102, all marketed by Rohm and Haas Company or Dow Chemical Company (currently purchased from R&H).

3) The condensates of ethylene oxide with a hydrophobic base that is formed by the condensation of propylene oxide with propylene glycol, such as PLURONIC® surfactants marketed by the Wyandotte Chemicals Corporation which is now part of BASF.

4) The condensates of ethylene oxide with the product resulting from the reaction of propylene oxide and ethylene diamine, such as the commercially available TETRONIC® compounds marketed by the Wyandotte Chemicals Corporation, now part of BASF.

The amide type of nonionic surfactants are ammonia, monoethanol and diethanol amides of fatty acids, which have an acyl moiety of from about 7 to about 18 carbon atoms.

The semi-polar type of nonionic surface-active agents include amine oxides, phosphine oxides and sulfoxides. Useful amine oxide detergents are selected from the coconut or tallow alkyl di- (lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Suitable semi-polar nonionic detergents also include the water-soluble phosphine oxides such as dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide. The semi-polar nonionic detergents useful herein also include the water-soluble sulfoxide detergents such as dodecylmethyl sulfoxide, 2-hydroxyethyltridecyl sulfoxide, hexadecylmethyl sulfoxide, 3-hydroxyoctadecylethyl sulfoxide.

Preferred nonionic surfactants for use herein have an HLB (hydrophilic/lipophilic balance) of from about 7 to about 16, and are selected from the polyethylene oxide condensates of aliphatic alcohols, polyethylene oxide condensates of alkyl phenols, and mixtures thereof. The preferred polyethylene oxide condensates of aliphatic alcohols have an alcohol moiety which is a straight chain hydrocarbon alcohol with an average chain length of 9 to 15 carbon atoms, preferably 11 to 15 carbon atoms, and most preferably 12 to 13 carbon atoms. These preferred polyethylene oxide condensates of aliphatic alcohols have an ethylene oxide chain length of 3 to 15 ethylene oxide moieties, preferably from about 3 to about 7 ethylene oxide moieties, and more preferably an average of 5 ethylene oxide moieties per molecule of surfactant. Thus, one particularly preferred surfactant for use herein is a condensate of a straight chain hydrocarbon alcohol having 12 to 13 carbon atoms, condensed with an average of 5 moles of ethylene oxide per molecule of surfactant. Another preferred material is of the polyethylene oxide condensates of alkyl phenols, preferred species have an alkyl chain length of from 8 to 9 carbon atoms and an average ethylene oxide chain length of 3 to 15 ethylene oxide moieties.

Anionic Surfactants

This class of surfactants includes ordinary alkali metal soaps such as the sodium, potassium, ammonium and alkanolammonium salts of higher fatty acids that contain from about 8 to about 24 carbon atoms and preferably from about 10 to about 20 carbon atoms. In the present description, free fatty acids having from 8 to 24 carbon atoms shall also be considered to be anionic surfactants.

Useful anionic surfactants may also include water-soluble salts, particularly the alkali metal salts, of organic sulfuric reaction products having in their molecular structure an alkyl group containing from about 8 to about 22 carbon atoms and a sulfonic acid or sulfuric acid ester radical. Examples of this group of synthetic detergents are the water-soluble (i.e., sodium, potassium, magnesium or ammonium) alkyl sulfates, especially those obtained by sulfating the higher alcohols ($C_8$-$C_{18}$ carbon atoms) produced by reducing the glycerides of tallow or coconut oil; sodium or potassium alkyl benzene sulfonates, in which the alkyl group contains from about 8 to 18 carbon atoms in straight chain or branched chain configuration, e.g., those of the type described in U.S. Pat. Nos. 2,220,099 and 2,477,383 (especially valuable are linear straight chain alkyl benzene sulfonates in which the average chain length of the alkyl group is about 11.8 carbon atoms, commonly abbreviated as LAS); sodium alkyl glyceryl ether sulfonates, especially those ethers of higher alcohols derived from tallow and coconut oil; and sodium coconut oil fatty acid monoglyceride sulfonates and sulfates.

Another group of anionic surfactants is the alkali metal paraffin sulfonates, which contain from about 8 to 22 carbon atoms in the paraffin chain. These are well-known commercially available surfactants which can be prepared, for example, by the reaction of olefins with sodium bisulfite. Examples are sodium-1-decane sulfonate, sodium-2-tridecane sulfonate and potassium-2-octadecane sulfonate.

Other synthetic anionic surfactants useful herein are alkyl ether sulfates, such as sodium coconut alkyl ethylene glycol ether sulfate, lithium tallow alkyl triethylene glycol ether sulfate, sodium tallow alkyl hexaoxyethylene sulfate and sodium tallow alkyl trioxyethylene sulfate. The alkyl ether sulfates are known compounds and are described in U.S. Pat. No. 3,332,876 to Walker (Jul. 25, 1967), hereby incorporated herein by reference.

More preferred anionic surfactants include $C_8$ to $C_{16}$ alkyl benzene sulfonates, $C_{12}$ to $C_{18}$ alkyl sulfates, $C_{12}$ to $C_{18}$ ethoxylated alkyl sulfates having from 1 to 10 ethoxy moieties, and sodium paraffin sulfonates wherein the alkyl portion contains from 8 to 16 carbon atoms. For reasons of economics and environmental compatibility, sodium linear alkyl benzene sulfonates having from 11 to 12 carbon atoms ($C_{11.8}$ avg.), such as dodecylbenzene sulfonic acid ("DBSA") in the alkyl portion, are most preferred.

Cationic Surfactants

Suitable cationic surfactants are mono- (long chain) quaternary ammonium surfactants, polyammonium salts, choline ester derivatives and the imidazolinium variety.

When used in combination with nonionic surfactants, these cationic surfactants provide some soil removal characteristics, but more often confer static control and fabric softening benefits to the laundered fabrics, inhibit the transfer of dyes among the laundered fabrics in the wash solutions and sanitize the wash load.

Zwitterionic Surfactants

Other useful surfactants herein are zwitterionic surfactants that are selected from internally neutralized derivatives of aliphatic quaternary ammonium, phosphonium and tertiary sulfonium compounds and water-soluble betaine surfactants.

Solvents

The liquid phase may include any non-aqueous solvent known in the art, such as (but not limited to) hydrocarbon, alkylene glycol or alcohol solvents. Alkanes, the lower hydrocarbon alcohols, ethylene or propylene glycol and glycerine are specific solvents that may be used. One preferred solvent is polyethylene glycol having a molecular weight range of from about 380 to 420, and this polyethylene glycol may be blended with glycerin.

Dispersed Solid Phase

The anhydrous detergent composition of the present invention includes 1 wt. % to 65 wt. %, preferably 15 wt. % to 55 wt. %, more preferably 20 wt. % to 45 wt. %, of a solid phase that contains dispersed particulate materials, which are insoluble in the liquid phase. The dispersed particulate materials include at least one enzyme, and either at least one builder, at least one bleaching agent or mixtures thereof.

Enzymes

The enzymes of this invention are solid and catalytically active protein materials, which degrade or alter one or more types of soil or stains during a laundering process, so as to remove the soil or stain from the fabric or object being laundered. Both the degradation and alteration improve soil removability. Suitable enzymes include enzymes that are selected from peroxidases, proteases, glucoamylases, α-amylase, amylases, xylanases, cellulases, lipases, phospholipases, esterases, cutinases, pectinases, keratanases, reductases, oxidases, phenoloxidases, lipoxygenases, lignines, pullulanases, tannases, pentosanases, malanases, β-glucanases, arabinosidases, hyaluronidase, chondroitinase, dextranase, transferase, laccase, mannanase, xyloglucanases and mixtures thereof. The anhydrous detergent composition of the present invention may include a cocktail of conventionally applicable enzymes like protease, amylase, cellulase and lipase. Typical levels of the enzymes that are used in the present invention are from about 0.0001 wt. % to about 5.0000 wt. %, preferably 0.01 wt. % to 4.00 wt. % and more preferably 1 wt. % to 4 wt. % of the anhydrous detergent composition.

Bleaches

The dispersed particulate materials useful herein may include peroxygen or chlorine laundry bleaches. Such bleaches comprise about 0 wt. % to 50 wt. % of the anhydrous detergent composition. If a peroxygen bleach is selected for use herein, it preferably comprises about 0 wt. % to 40 wt. % of the anhydrous detergent composition, more preferably, about 20 wt. % of the anhydrous detergent composition in the case of inorganic peroxygen bleaches. Organic bleaches may comprise about 10 wt. % of the anhydrous detergent composition. If a chlorine bleach is selected for use herein, the bleach preferably comprises about 0 wt. % to about 50 wt. % of the anhydrous detergent composition.

Bleaches useful herein include the peroxygen bleaches. While any of the solid peroxygen bleaches known in the art may be used herein, preferred peroxygen bleaches for use herein are selected from alpha-omega diperoxyacids that have chain lengths of from 6 to 16 carbon atoms; alkali metal/alkaline metal perborates, persulfates, persilicates, perphosphates, and percarbonates; alkyl mono- and diperoxysuccinic acids that have alkyl chain lengths of from 8 to 18 carbon atoms; and benzoyl peroxide and mixtures thereof. Preferably, the bleaching agent for the present invention is sodium percarbonate.

If any inorganic peroxy bleaches are to be used, it may also be desirable to include an inorganic peroxy compound activator in the dispersed solid phase of the anhydrous detergent composition. Inorganic peroxy compound activators are well known in the art and are described extensively in the literature. One class of peroxy compound activators useful herein is that of anhydrides. These anhydrides can be aliphatic, aromatic or mixed and can be derived from mono- or polycarboxylic acids. Preferred aliphatic anhydrides have individual aliphatic groups containing 1-12 carbon atoms and mixed aliphatic anhydrides should contain no more than 20 carbon atoms. Specific aliphatic anhydrides include acetic, propionic, butyric, heptanoic, nonanoic, acetic-hexadecanoic, acetic-stearic and butyric-myristic anhydrides.

Builders

The builders that are used in the present invention can be either organic or inorganic builder salts. Suitable inorganic builder salts useful herein include alkali metal/earth metal carbonates, bicarbonates, borates, aluminates, phosphates, polyphosphates, sulfates, chlorides and silicates. Specific examples of these salts are sodium or potassium tripolyphosphate, tetraborate, perborate, aluminate, carbonate, bicarbonate, orthophosphate, pyrophosphate, sulfate and hexametaphosphate. Zeolites and aluminosilicates are also useful.

Suitable organic builder salts include the alkali metal, ammonium and substituted ammonium polyphosphonates, polyacetates and polycarboxylates. Preferably, the builder that is useful in the present invention is sodium carbonate ("soda ash"). The builder is present in the amount of about 0 wt. % to 50 wt. %, preferably about 0 wt. % to 40 wt. % and more preferably about 0 wt. % to 30 wt. % of the anhydrous detergent composition.

Clay Mixture

The anhydrous detergent composition further includes about 1 wt. % to 15 wt. %, preferably about 1 wt. % to 12 wt. % and, more preferably, about 1 wt. % to 8 wt. % of a clay mixture, which has been processed or treated with alkyl quaternary ammonium compounds.

Such mineral clay mixture is comprised of mineral clay (a) comprising 50 wt. % to 95 wt. %, based on the weight of the mineral clay mixture of a mineral clay that is selected from the group consisting of sepiolite, palygorskite and mixtures of sepiolite and palygorskite; and mineral clay (b) comprising the balance by weight of the clay mixture of a smectite. Preferably, the mineral clay (a) is present in an amount of about 60 wt. % to 95 wt. %, and more preferably about 70 wt. % to 90 wt. % based on the weight of the mineral clay mixture.

The process for making the clay mixture and a more detailed description of the clay mixture can be found in U.S. Pat. No. 6,036,765 to Farrow, et al., which is incorporated herein by reference.

For mineral clay (a), sepiolite is preferred for use in the invention. Both sepiolite and palygorskite are included in the phyllosilicates because they contain a continuous two-dimensional tetrahedral sheet of composition $T_2O_5$ (T=Si, Al, Be . . . ), but they differ from the other layer silicates in lacking continuous octahedral sheets. Further details of the structures of these minerals, including the structural distinctions between the two, may be found in B. F. Jones and E. Galan "Sepiolite and Palygorskite", Chapter 16 of Hydrous Phyllosilicates, Reviews in Mineralogy, Volume 19, (Mineralogical Society of America, Washington, D.C., 1988).

Preferably, the smectite is a natural or synthetic clay mineral selected from the group consisting of hectorite, montmorillonite, bentonite, beidelite, saponite, stevensite and mixtures thereof. A particularly preferred choice of the smectite is hectorite.

The alkyl quaternary ammonium salts that are employed to treat the mineral clay mixture contain the same or different straight- and/or branched-chain saturated and/or unsaturated alkyl groups of 1 to 22 carbon atoms, and the salt moiety is selected from the group consisting of chloride, bromide, methylsulfate, nitrate, hydroxide, acetate, phosphate and mixtures thereof, preferably chloride, bromide and methylsulfate. The preferred choices of the alkyl quaternary ammonium salts are dimethyl di(hydrogenated tallow) ammonium chloride, methylbenzyl di(hydrogenated tallow) ammonium chloride, dimethylbenzyl hydrogenated tallow ammonium chloride, dimethyl hydrogenated tallow-2-ethylhexylammonium methylsulfate and mixtures of two or more of the preferred choices. The mineral clay mixture is typically treated with 5 to 80 meq. of the alkyl quaternary ammonium salt per 100 g of the mixture. Where the organoclay is used in high temperature drilling fluids, a more preferred range is 5 to 50 meq., and even more optimal, 10 to 35 meq of the alkyl quaternary ammonium salt per 100 g of the mixture is used. For many other thixotropic applications, a range of about 25 to 80, and preferably 35 to 65 meq. of the alkyl quaternary ammonium salt is used per 100 g of the clay mixture.

The preferred clay mixture for the present invention is commercially available as Garamite® (Southern Clay Products, TX). In particular, Garamite® 1958 and Garamite® 2578 are useful.

Optional Ingredients

Water

The liquid anhydrous detergent composition of the present invention may contain small amounts of water. The preferred composition contains about 0 wt. % to 10 wt. % of water, preferably about 0 wt. % to 5 wt. % of water, and more preferably, no water in the anhydrous detergent composition. It has been found that in some cases a small quantity of water increases the stability of the detergent composition, although this is not true for a larger proportion of water than is called for in the present specification. Thus, water does not appear to function primarily as a solvent in the present composition.

Fragrance

The present invention may also include perfumes. The perfumes may be prepared as a premix liquid, may be linked with a carrier material such as cyclodextrin, or may be encapsulated.

Other Adjuncts/Auxiliaries

Examples of other suitable cleaning adjunct materials or auxiliaries include, but are not limited to, metasilicates; alkoxylated benzoic acids or salts thereof such as trimethoxy benzoic acid or a salt thereof ("TMBA"); enzyme stabilizing systems; scavenging agents including fixing agents for anionic dyes; defoaming agents; complexing agents for anionic surfactants, and mixtures thereof; optical brighteners or fluorescers; soil release polymers; dispersants; suds suppressors; fillers; dyes; colorants; hydrotropes such as toluenesulfonates, cumenesulfonates and naphthalenesulfonates; color speckles; colored beads, spheres or extrudates; clay softening agents and mixtures thereof.

The present invention may also contain a suds suppressor component that is selected from alkyl phosphate esters; long chain fatty acids; silicone suds suppressing additives such as alkylated polysiloxane materials, a mixture of an alkylated siloxane, self-emulsifying silicone suds suppressors (e.g. DB-544, commercially available from Dow Corning); microcrystalline waxes having a melting point in the range from 35° C.-115° C.; and a saponification value of less than 100.

Making of the Anhydrous Detergent Composition

The anhydrous detergent composition of the present invention is made under high shear mixing conditions. These conditions are provided by using any of the high-shear stirring apparatuses available in the art. The anhydrous detergent composition may be made as follows, although the order of addition of the ingredients is not critical in order to produce an acceptable composition.

First, the ingredients which are to form the liquid phase are placed in a mixer and then the impeller is started. Next, the materials that form the dispersed solid phase of the anhydrous detergent composition and the processed clay mixture are mixed with the liquid phase. Finally, any optional ingredients that have not already been added are then mixed into the composition. To provide the structure and viscosity (at rest) that is necessary to produce a stable suspension, the high shear mixing process is continued until the processed clay mixture is sufficiently dispersed throughout the composition. A long mixing time will result in a product having increased viscosity, thus providing a less mobile but more stable product. A shorter mixing time will have the opposite effect. Thus, the appropriate mixing time will vary in a given application. As a general rule, if a product of the lowest attainable viscosity is desired, the composition should be mixed no longer than is necessary to provide the necessary degree of stability with respect to settling. The preferred anhydrous detergent compositions herein are those that are either pourable or pumpable in the form of slurry or paste.

The ready-made anhydrous detergent composition is then packaged within a pouch, a sachet or a container of any type that allows for a quick and efficient distribution of the detergent within a washing environment for cleaning. Preferably, the ready-made anhydrous detergent composition is packaged within a pouch that is made with a dissolvable film, which is hydrolytically degradable and water-soluble. This film material can be a blend of polylactide and polyvinyl alcohol ("PVA").

Example 1

Anhydrous detergent samples that contained various amounts of surfactants, solvents, clay mixtures and granular enzymes were produced and are set forth in Table 1. The samples were labeled as "A" through "J". Ingredients of a conventional liquid detergent "X" are listed for comparison purposes:

TABLE 1

| Sample | Nonionic Surfactant (%) | Sodium Percarbonate or Carbonate (%) | Anionic Surfactant (%) | PEG (%) | Propylene Glycol (%) | Water (%) | Clay-Garamite ® (%) | Enzymes (%) |
|---|---|---|---|---|---|---|---|---|
| A | 60 | 30 | 0 | 3 to 6 | 0 to 2 | 2 to 4 | 0.5 to 2 | 1.5 |
| B | 60 | 30 | 0 | 2 to 6 | 2 | 2.3 | 0.52 | protease |
| C | 63 | 30 | 0 | 2 to 6 | 0 | 2.4 | 0.5 | only |
| D | 52 | 30 | 0 | 2 | 2 | 0 | 2 | |
| E | 36 | 30 | 0 | 2 | 2 | 0 | 2 | |
| F | 36 | 30 | 16 | 2 | 2 | 0 | 2 | |
| G | 44 | 30 | 14 | 2 | 2 | 0 | 2 | |
| H | 48 | 30 | 16 | 2 | 2 | 2.3 | 0.6 | |
| I | 25 | 30 | 18 | 2 | 2 | 0 | 2 | |
| J | 25 | 30 | 28 | 16 | 0 | 2 to 4 | 2 | |
| X | 3 | 0 | 10 | 0 | 0 | 70 | 0 | 1.5 protease + 0.4 amylase |

Example 2

The enzyme stability was determined by testing the stain removal efficacy of the anhydrous compositions after the composition was aged at various conditions. To test the enzyme stability within the anhydrous detergent composition, sample D from Example 1 was duplicated and one set was stored at 122° F. for one week and then tested, while another set was placed at room temperature (RT) and tested immediately. The samples were prepared using sodium carbonate and Garamite® 2578 clay. A modified sample of D was also produced with a mixture of sodium carbonate ("$Na_2CO_3$") and sodium percarbonate ("Na PC"). This sample was also duplicated to test the enzyme stability.

Stain removal efficacy was conducted according to standardized industry method ASTM D4265-98 with the following details:

1. The washing procedure involved testing with a fixed range of conditions: wash temperature 88 F, water hardness 100 ppm, regular wash and rinse cycle, 12 min wash cycle duration.
2. Instrumental evaluation was used in this testing. The procedure involved quantitative measurement of reflectance on unwashed and washed fabric using a photoelectric colorimeter. The cumulative Stain Removal Index (% SR) was calculated for eight various stain types in different stain type categories: enzymatic, alkaline and oxidative (using 4 replications each).

Shown in Table 2, it can be seen from the results that the aged products demonstrated statistically equal stain removal efficacy to their fresh or room temperature aged versions.

TABLE 2

| Product | Enzymatic Stain-Soil Removal | Alkaline Stain-soil Removal | Oxidative Stain-Soil Removal | Total Stain and Soil Removal |
|---|---|---|---|---|
| Sample D: 30% $Na_2CO_3$, aged 1 wk. at RT | 581.0 | 357.7 | 490.4 | 1321.8 |
| Sample D: 30% $Na_2CO_3$ aged 1 wk. at 122° F. | 574.6 | 351.6 | 482.9 | 1301.9 |
| Sample D (MOD): 15% $Na_2CO_3$ + 15% Na PC aged 1 wk. at RT | 551.62 | 362.5 | 494.3 | 1305.4 |

TABLE 2-continued

| Product | Enzymatic Stain-Soil Removal | Alkaline Stain-soil Removal | Oxidative Stain-Soil Removal | Total Stain and Soil Removal |
|---|---|---|---|---|
| Sample D (MOD): 15% $Na_2CO_3$ + 15% Na PC aged 1 wk. at 122° F. | 557.4 | 355.8 | 486.8 | 1298.6 |

Example 3

Percarbonate stability was evaluated through the aging of anhydrous detergent samples up to 42 days by determining % Active Oxygen Loss. Two samples were prepared using the specification of sample A (with two different levels of Garamite® clay) from Example 1. An additional sample (Sample A MOD) was prepared using bentonite (Pangel B20) as a suspension agent replacing the Garamite® clay. Another sample (Sample A-NC) was prepared with no clay or other suspension agents. The days in storage at room temperature were counted from day 1 until the day that the phase separation within the samples was visually observed. The active oxygen in each sample was measured prior to the aging process, and it was measured again when the phase separation occurred in each sample to obtain the percentage of active oxygen loss. For testing purposes, "NS" stands for nonionic surfactants, and "Na PC" stands for sodium percarbonate. Results are shown in Table 3.

TABLE 3

| Sample | % Active Oxygen Lost in RT | Days of Stability |
|---|---|---|
| Sample A1: 2% Garamite ®, 60% NS, 30% Na PC | 2.31 | 42 |
| Sample A2: 0.58% of Garamite ®, 60% NS, 30% Na PC, 2.4% water | 0.97 | 36 |
| Sample A (MOD) 1.5% Pangel B20, 60% NS, 30% Na PC | 4.66 | 34 |
| Sample A-NC 60% NS, 30% Na PC, No clay | 2.26 | 34 |

It can be seen from the data that the samples A1 and A2 that contained Garamite® had low levels of active oxygen loss and/or had a longer storage time, as compared to the control samples (No clay and Pangel B20).

Example 4

A test was conducted to analyze the effect of different clays on the suspension stability of the anhydrous detergent composition.

Samples K and L were prepared according to the specification of sample A from Example 1, except that the clay component was 1.8 wt. % of trialkylaryl ammonium hectorite (Bentone 27). Sample K was placed at 122° F. for about one month, and sample L was placed at 140° F. for about one month.

Samples M and N were prepared according to the specification of sample A from Example 1, except that 1.8 wt. % of Garamite® 2578 was used. Sample M was placed at 122° F. for about one month, and sample N was placed at 140° F. for about one month.

Throughout the one-month storage time, a transmission scan was conducted on Days 0, 1, 2, 5, 7, 8, 9, 12 and 28 for each sample. The transmission profile was recorded as a function of the height along the sample vial. Changes within the transmission profile indicated settling, creaming or flocculation within the samples. Decreasing transmission at the top of the vial (>40 mm mark) and increasing transmission through the height of the vial (between 20-40 mm marks) was typical of suspensions that settled and were unstable. The transmission profile for Sample K is shown in FIG. 1A, for Sample L, FIG. 1B, for Sample M, FIG. 2A and for Sample N, FIG. 2B.

Figure 1B:
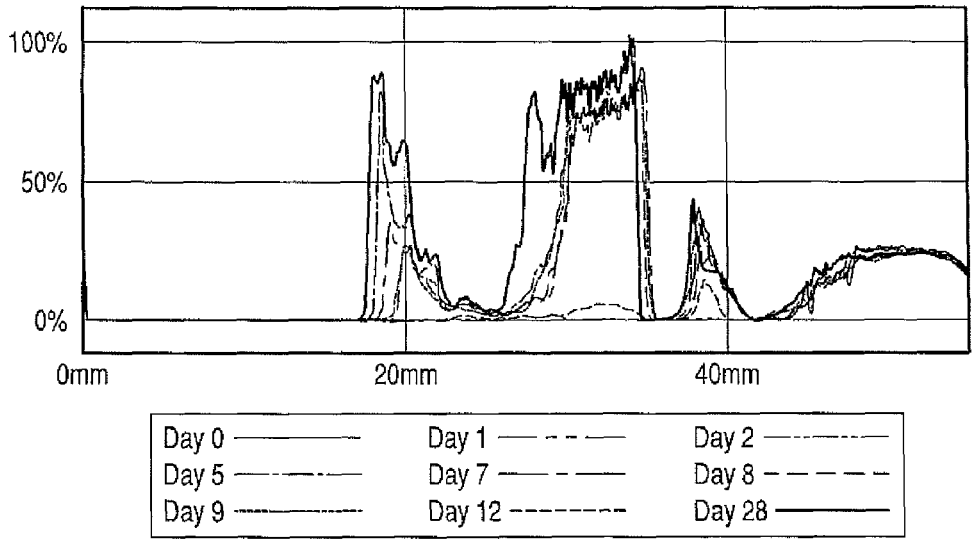
FIG. 1B illustrates a transmission scan of a detergent composition comprising 1.8 wt. % bentonite clay that was aged at 140° F. from Day 0 to Day 28.
Figure 2A:
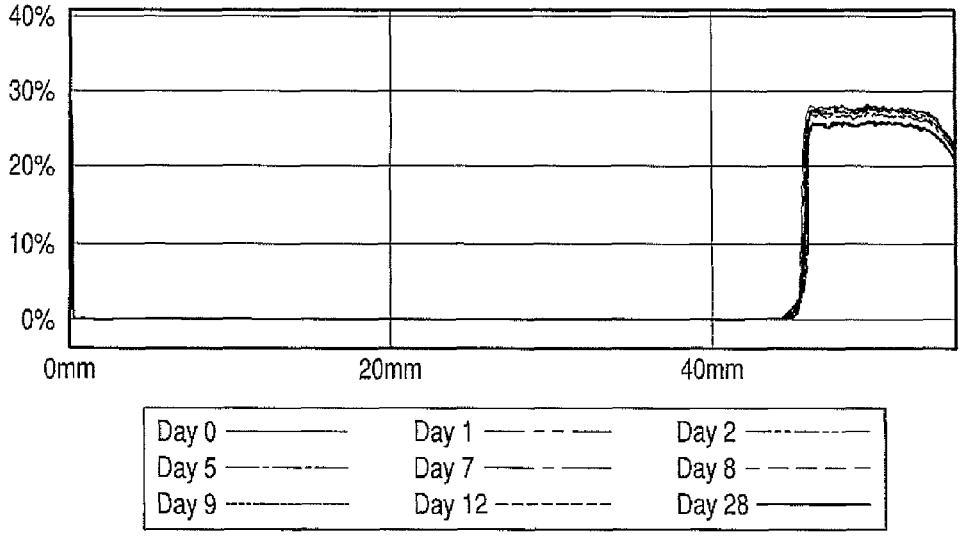
FIG. 2A illustrates a transmission scan of a detergent composition comprising 1.8 wt. % garamite clay that was aged at 122° F. from Day 0 to Day 28.
Figure 2B:
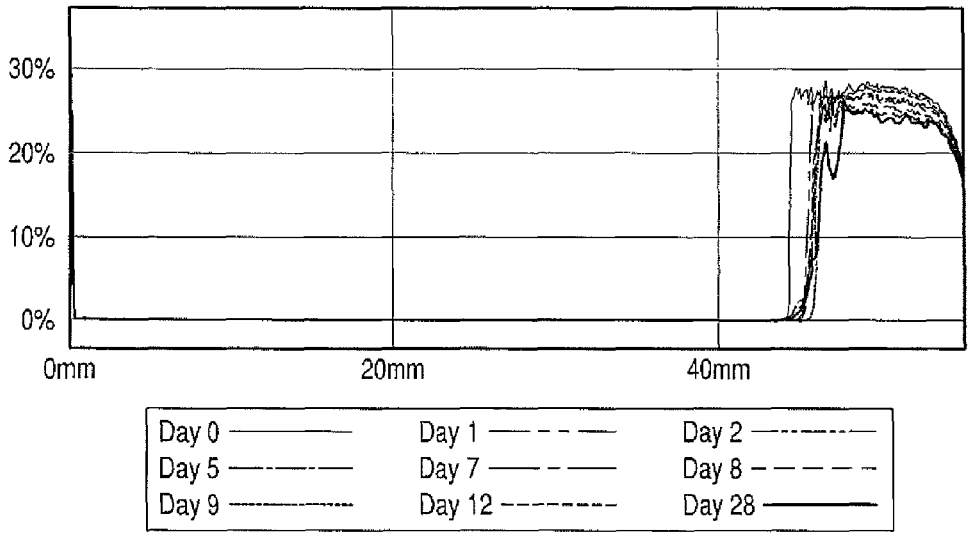
FIG. 2B illustrates a transmission scan of a detergent composition comprising 1.8 wt. % garamite clay that was aged at 140° F. from Day 0 to Day 28.

It can be observed from FIGS. 1A and 1B that samples K and L were unstable and had settling. Meanwhile, FIGS. 2A and 2B show that samples M and N were stable throughout their storage period. The transmission scans of samples M and N confirm the surprisingly improved stability of the Garamite®-containing anhydrous detergent composition.

Example 5

Figure 3:
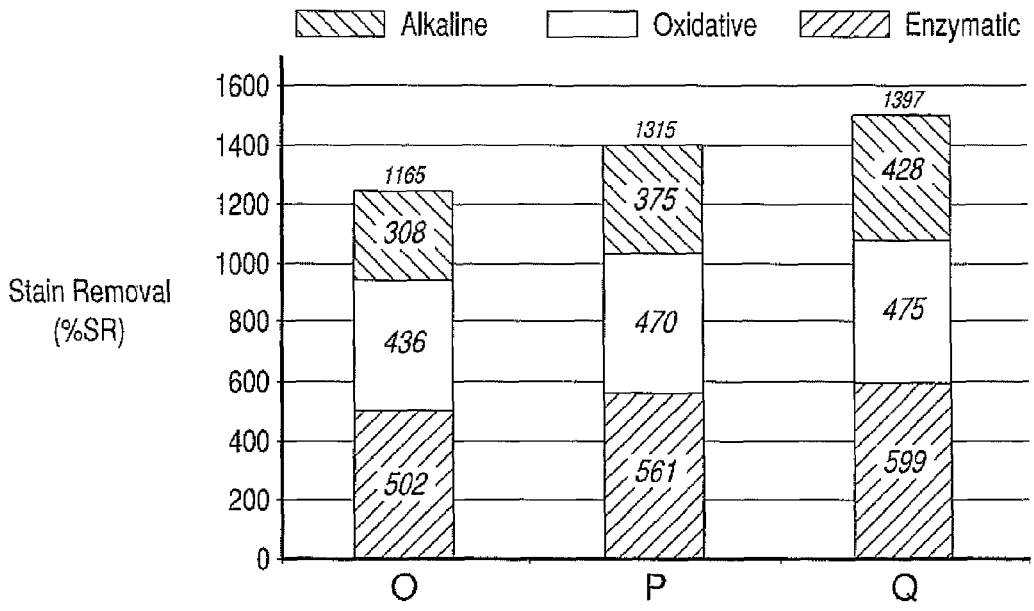
FIG. 3 illustrates the stain removal performance of various detergent samples.

A test was conducted to compare the cleaning performance of this anhydrous composition as a detergent booster against the commercial laundry booster product used along with commercial liquid laundry detergent. 30 grams of a Garamite®-containing anhydrous composition (Sample Q) and 61 grams of a conventional laundry booster product with no clay (Sample P) were compared to 61 grams of a liquid detergent alone (Sample P). The cumulative Stain Removal Index (% SR) along with the % SR for each stain group are shown in FIG. 3. FIG. 3 demonstrates superior cleaning of sample Q (1397%) at about half of the amount of sample P and significantly improved the detergent performance alone (Sample O) (1315% and 1165%).

Example 6

The following formulation, as shown in Table 4, was made to test consumers' responses of its cleaning and whitening performance. The responses were very positive and visually discernible by consumers.

TABLE 4

Consumer Test composition

| Chemical | wt. % |
|---|---|
| Clay (Garamite ®) | 1.80 |
| Polyethylene Glycol | 16.20 |
| Dyes | 0.02 |
| Nonioic Surfactant (Alkyl Ethoxylate) | 35.60 |
| Anioic Surfactant (DBSA) | 12.00 |
| Soda Ash (Dense) | 30.00 |
| Brightener | 0.33 |
| Fragrance | 0.30 |
| Amylase | 0.76 |
| Protease | 3.00 |
| Total | 100.00 |

The invention claimed is:

1. An anhydrous laundry detergent composition comprising a liquid phase and a dispersed solid phase comprising:

a) at least one enzyme;

b) a processed clay mixture as a stabilizer to reduce phase separation in said composition, wherein said clay mixture comprises smectite and a clay selected from the group consisting of sepiolite, palygorskite and mixtures thereof, wherein said clay mixture is processed with alkyl quaternary ammonium salts; and c) at least one component selected from the group consisting of a builder, a bleaching agent, and mixtures thereof.

2. The anhydrous detergent composition of claim 1, wherein said liquid phase comprises at least one surfactant.

3. The anhydrous detergent composition of claim 2, wherein said at least one surfactant is selected from the group consisting of nonionic, anionic, cationic, zwitterionic and mixtures thereof.

4. The anhydrous detergent composition of claim 3, wherein said surfactant is selected from the group consisting of a linear primary alcohol ethoxylate, dodecylbenzene sulfonic acid and mixture thereof.

5. The anhydrous detergent composition of claim 2, wherein said surfactant is present in an amount of 10 wt. % to 60 wt. % of said anhydrous detergent composition.

6. The anhydrous detergent composition of claim 1, wherein said liquid phase further includes at least one solvent.

7. The anhydrous detergent composition of claim 6, wherein said solvent is selected from the group consisting of polyethylene glycol, polypropylene glycol and mixtures thereof.

8. The anhydrous detergent composition of claim 7, wherein said solvent is present in an amount of 1 wt. % to 30 wt. % of said anhydrous detergent composition.

9. The anhydrous detergent composition of claim 1, wherein said composition includes no more than 5 wt. % of water.

10. The anhydrous detergent composition of claim 1, wherein said at least one enzyme is selected from lipase, amylase, protease, cellulose and mixtures thereof.

11. The anhydrous detergent composition of claim 10, wherein said at least one enzyme is present in an amount of 0.01 wt. % to 5 wt. % of said anhydrous detergent composition.

12. The anhydrous detergent composition of claim 1, wherein said builder is selected from the group consisting of alkali metal or earth metal carbonates, bicarbonates, and borates.

13. The anhydrous detergent composition of claim 12, wherein said builder is present in an amount up to 40 wt. % of said anhydrous detergent composition.

14. The anhydrous detergent composition of claim 1, wherein said bleaching agent is sodium percarbonate.

15. The anhydrous detergent composition of claim 14, wherein said bleaching agent is present in an amount up to 40 wt. % of said anhydrous detergent composition.

16. The anhydrous detergent composition of claim 1, wherein said processed clay mixture is present in an amount of about 1 wt. % to 8 wt. % of said anhydrous detergent composition.

17. The anhydrous detergent composition of claim 1, wherein said composition is in form of pourable slurry or paste.

18. The anhydrous detergent composition of claim 1, wherein said composition is enclosed within a pouch, a sachet or a container.

19. The anhydrous detergent composition of claim 18, wherein said composition is enclosed within a dissolvable pouch.

* * * * *